United States Patent [19]

Yagher, Jr.

[11] 4,342,981

[45] Aug. 3, 1982

[54] THERMALLY ACTUATABLE ELECTRICAL SWITCH CONSTRUCTION, CONDUCTIVE LEAD THEREFOR AND METHODS OF MAKING THE SAME

[75] Inventor: Charles Yagher, Jr., Kettering, Ohio

[73] Assignee: Emerson Electric Co., St. Louis, Mo.

[21] Appl. No.: 222,597

[22] Filed: Jan. 5, 1981

[51] Int. Cl.[3] ..... H01H 37/76

[52] U.S. Cl. ..... 337/407; 174/152 R; 337/409; 403/267

[58] Field of Search ..... 337/407, 408, 409; 174/152 R, 165, 170; 339/218 R, 218 C; 403/267, 265, 268, 266

[56] References Cited

U.S. PATENT DOCUMENTS

| | | | |
|---|---|---|---|
| 306,719 | 10/1884 | Clark | 174/170 |
| 3,770,878 | 11/1973 | Dozier | 174/153 |
| 4,060,787 | 11/1977 | Budnik | 337/407 |

FOREIGN PATENT DOCUMENTS

| | | | |
|---|---|---|---|
| 510363 | 2/1955 | Canada | 174/152 R |
| 386305 | 12/1923 | Fed. Rep. of Germany | 174/152 R |
| 1046171 | 12/1958 | Fed. Rep. of Germany | 174/152 R |

*Primary Examiner*—Harold Broome

*Attorney, Agent, or Firm*—Candor, Candor & Tassone

[57] ABSTRACT

A thermally actuatable electrical switch construction having a housing carrying an electrically insulating end plug provided with an opening passing therethrough and in which a portion of a conductive lead is disposed so that opposed ends of the lead extend beyond opposed ends of the plug and respectively define a fixed contact inside the housing and a terminal outside the housing, the portion of the lead being retained in the opening by a sealing compound disposed in the opening and extending around the portion of the lead and interlocking therewith to tend to prevent axial movement of the lead into the housing as well as to tend to prevent rotational movement of the lead relative to the end plug. The portion of the lead has a substantially cylindrical peripheral surface throughout the entire length thereof with an annular recess therein that defines an annular reduced section in the portion that has an annular peripheral surface disposed inboard of the cylindrical peripheral surface throughout its entire length and has at least one flat surface part thereof that interlocks with the sealing compound in the opening of the end plug.

20 Claims, 4 Drawing Figures

THERMALLY ACTUATABLE ELECTRICAL SWITCH CONSTRUCTION, CONDUCTIVE LEAD THEREFOR AND METHODS OF MAKING THE SAME

BACKGROUND OF THE INVENTION

1. Field of the Invention

This invention relates to an improved thermally actuatable electrical switch construction and to a conductive lead therefor as well as to methods of making the same.

2. Prior Art Statement

It is known to provide a thermally actuatable electrical switch construction having a housing means carrying an electrically insulating end plug provided with an opening means passing therethrough and in which a portion of a conductive lead is disposed so that opposed ends of the lead extend beyond opposed ends of the plug and respectively define a fixed contact means inside the housing means and a terminal outside the housing means, the portion of the lead being retained in the opening means by a sealing means disposed in the opening means and extending around the portion of the lead and interlocking therewith to tend to prevent axial movement of the lead into the housing means as well as to tend to prevent rotational movement of the lead relative to the end plug.

For example, see the following item:

(1) U.S. Pat. No. 4,060,787—Budnik

It appears that the portion of the lead that is disposed in the opening means of the end plug of the thermally actuatable electrical switch construction of item (1) above is provided with a plurality of radially disposed reliefs deformed into the portion of the lead in a manner to prevent each relief from extending around the entire circumference of the lead so as to cause the sealing means to enter the reliefs and form set blocks of sealing means that tend to prevent axial movement of the lead into the housing means as well as to tend to prevent rotational movement of the lead relative to the end plug.

It is also known to hermetically seal an electrical terminal pin in a sleeve-like opening of a supporting body by means of a molded dielectric sealing member which coacts with the terminal pin and the supporting body.

For example, see the following item:

(2) U.S. Pat. No. 3,770,878—Dozier

It appears that the terminal pin of the arrangement of item (2) above is provided with a plurality of axially disposed shoulders to provide means for coacting with the molding material to tend to prevent axial movement therebetween (see column 5, lines 24–26) and is provided with a roughened surface or a knurled surface on an annular reduced portion thereof to tend to prevent rotational movement therebetween (see column 5, lines 35 and 36).

SUMMARY OF THE INVENTION

It is one feature of this invention to provide an improved thermally actuatable electrical switch construction wherein the conductive lead that is carried in an opening means of an insulating end plug is interlocked to the sealing means that is disposed in the opening means of the end plug and surrounds the portion of the lead therein to tend to prevent axial movement of the lead into the housing means that carries the end plug as well as to tend to prevent rotational movement of the lead relative to the end plug.

In particular, it has been found to be advantageous to interock the conductive lead of a thermally actuatable electrical switch construction in the opening means of the end plug carrying the same with the epoxy resin that flows by capillary action or other means into the opening means around the lead as the epoxy resin is being disposed on an external portion of the conductive casing, a projecting portion of the end plug and a terminal portion of the lead extending out of the end plug to hermetically seal the lead to the casing and thereby prevent air from entering the casing through the insulating end plug.

For example, see the aforementioned U.S. Pat. to Budnik, No. 4,060,787, for a teaching of some of the reasons for so interlocking the conductive lead with the sealing compound in the opening means of the end plug of a thermally actuatable switch construction as well as for a teaching of a method for so forming a lead and thereafter interlocking the same, the U.S. Patent to Budnik being incorporated into this disclosure by reference thereto.

However, it is believed according to the teachings of this invention that the conductive lead of a thermally actuatable electrical switch construction can be formed in another unique manner to interlock with the sealing compound in a manner to be effective in preventing axial movement of the lead in the opening means of the end plug as well as preventing rotational movement therebetween.

In particular, it is believed according to the teachings of this invention that the portion of the lead that is to be disposed in the opening means of the end plug of the thermally actuatable electrical switch construction can be formed in a manner to provide an annular recess therein that defines an annular reduced section on the portion that has at least one flat surface which will interlock with the sealing means subsequently disposed and set in the opening means of the end plug.

For example, one embodiment of this invention provides a thermally actuatable electrical switch construction having a housing means carrying an electrically insulating end plug provided with an opening means passing therethrough and in which a portion of a conductive lead is disposed so that opposed ends of the lead extend beyond opposed ends of the plug and respectively define a fixed contact inside the housing means and a terminal outside the housing means, the portion of the lead being retained in the opening means by a sealing means disposed in the opening means and extending around a portion of the lead and interlocking therewith to tend to prevent axial movement with the lead into the housing means as well as to tend to prevent rotational movement of the lead relative to the end plug. The portion of the lead has a substantially cylindrical peripheral surface throughout the entire length thereof with an annular recess therein that defines an annular reduced section in said portion that has an annular peripheral surface disposed inboard of the cylindrical peripheral surface throughout its entire length and has at least one flat surface part thereof that interlocks with the sealing means in the opening means of the end plug.

Accordingly, it is an object of this invention to provide an improved thermally actuatable electrical switch construction having one or more of the novel features of this invention as set forth above or hereinafter shown or described.

Another object of this invention is to provide a method of making such a thermally actuatable electrical switch construction, the method of this invention having one or more of the novel features of this invention as set forth above or hereinafter shown or described.

Another object of this invention is to provide an improved conductive lead for a thermally actuatable electrical switch construction, the lead of this invention having one or more of the novel features of this invention as set forth above or hereinafter shown or described.

Another object of this invention is to provide a method of making such a conductive lead, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
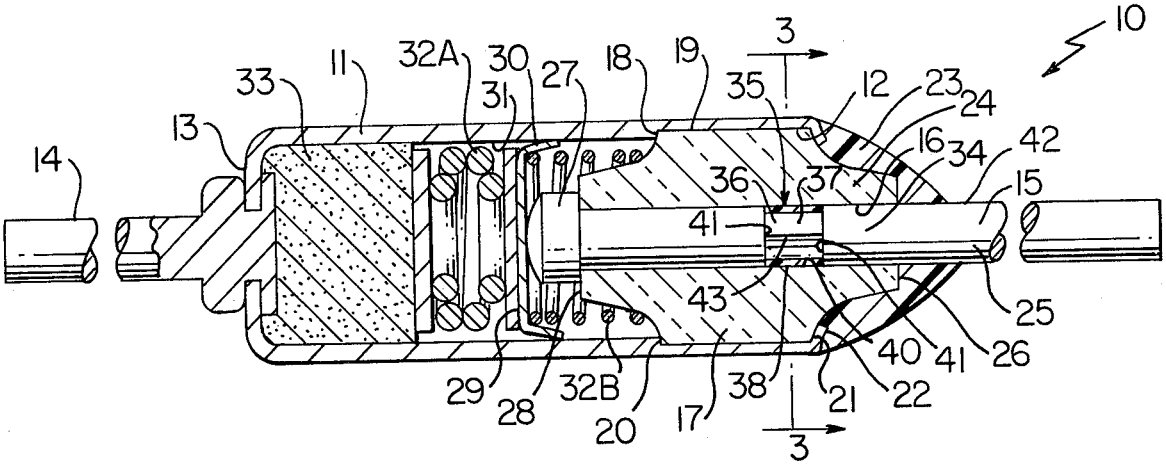
FIG. 1 is a cross-sectional view of the improved thermally actuatable electrical switch construction of this invention.

While the various features of this invention are hereinafter described and illustrated as being particularly adapted to provide a thermally actuatable electrical switch construction, it is to be understood that the various features of this invention can be utilized singly or in any combination thereof to provide other types of electrical switch construction as desired.

Therefore, this invention is not to be limited to only the embodiments illustrated in the drawings, because the drawings are merely utilized to illustrate one of the wide variety of uses of this invention.

Referring now to FIG. 1, the improved thermally actuatable electrical switch construction of this invention is generally indicated by the reference numeral 10 and is substantially of the same type and construction as the thermally actuatable electrical switch construction disclosed and claimed in the U.S. Pat. to Merrill, No. 3,519,972 and such U.S. Patent to Merrill is being incorporated into this disclosure by reference thereto for setting forth the details of the structure and operation of the thermally actuatable electrical switch construction 10 of this invention. Therefore, it is only necessary to describe certain details of the thermally actuatable electrical switch construction 10 to understand the features of this invention.

In particular, the thermally actuatable electrical switch construction 10 includes an electrically conductive casing or housing means 11 formed of metallic material and having an open end 12 and a closed end 13 secured to an electrically conductive lead or terminal 14 while another electrically conductive lead 15 is carried in opening means 16 of an electrically insulating end plug 17 secured in the open end 12 of the casing or housing means 11 by having one end 18 of a cylindrical portion 19 thereof abutting a shoulder 20 of the casing 11 and the other end 21 being held by a turned over end 22 of the casing 11 whereby the end plug 17 is fixed in the open end 12 of the casing 11 and is hermetically sealed thereto by a suitable epoxy resin 23 being disposed on the exterior of the casing 11 at the turned end 22 thereof and over a projecting cone portion 24 of the end plug 17 and onto the end 25 of the lead 15 that projects beyond the adjacent end 26 of the end plug 17 as illustrated whereby the uncovered part of the end 25 of the lead 15 defines a terminal for the thermally actuatable electrical switch construction 10.

The lead 15 has an enlarged arresting head 27 that projects beyond the end 28 of the end plug 17 and bears against the same outboard of the opening means 16 to define a fixed contact within the casing 11 that is normally engaged by a movable disc-like contact member 29 that has outer peripheral resilient fingers 30 disposed in sliding and electrical contact with the internal peripheral surface 31 of the casing 11 as illustrated, the movable contact 29 normally being held in conductive contact with the fixed contact 27 by a compression spring 32A normally held in the compressed condition illustrated in FIG. 1 by a temperature sensitive member 33 that remains in the solid condition illustrated in FIG. 1 as long as the same is sensing a temperature below a predetermined temperature. However, when the temperature sensed by the member 33 exceeds the predetermined temperature thereof, the member 33 melts and thereby permits the compression spring 32A to expand so that a normally weaker compression spring 32B disposed between the end plug 17 and the movable contact member 29 can expand and move the movable contact 29 out of contact with the fixed contact 27.

Therefore, it can be seen that as long as the temperature sensing member 33 is in the solid condition illustrated in FIG. 1, an electrical circuit can be completed between the terminals 14 and 25. However, once the temperature sensitive member 33 melts, the force of the compression spring 32B now moves the movable contact 29 out of contact with the fixed contact 27 and holds the same out of contact with the fixed contact 27 so that the electrical circuit between the terminals 14 and 25 is permanently interrupted by the thermally actuated electrical switch construction 10.

As set forth in the aforementioned U.S. Pat. to Budnik, No. 4,060,787, it is desired to prevent someone from attempting to push axially inwardly on the lead 15, after the thermally actuatable switch construction 10 has been thermally actuated in the manner previously described, and break the bond between the epoxy resin 23 and the lead 15 so as to move the lead 15 into the casing 11 to again contact the fixed contact 27 against the movable contact 29. This could be accomplished by the person pushing inwardly on the lead 15 with sufficient force to break the bond between the epoxy resin 23 that has seeped into the bore or opening means 16 around the lead 15 or by that person first tending to rotate the lead 15 relative to the end plug 17 and thereby breaking such bond so as to thereafter push axially inwardly of the lead 15.

As previously stated, it is a feature of this invention to provide unique interlocking means between the lead 15 of this invention and the epoxy resin 23 that is disposed in the opening means 16 of the end plug 17.

In particular, it is believed that if the portion 34 of the lead 15 that will be subsequently disposed in the substantially cylindrical opening means 16 of the end plug 17 is initially formed with an annular recess 35 therein that defines an annular reduced section 36 that has at least one flat surface 37, the portion 34 of the lead 15 when subsequently disposed in the opening 16 will define one or more enlarged irregularly shaped areas or pockets 38 adjacent that flat side or sides 37 within the opening means 16 and in which the epoxy resin 23 will seep or flow and subsequently form a set irregular block or blocks 39 of hardened resin material that is substantially firmly bonded to the internal peripheral surface 40 of the end plug 17.

The irregularly shaped set block or blocks 39 of hardened epoxy resin material 23 now provide a wedging action on the flat surface or surfaces 37 that prevent rotational movement of the lead 15 relative to the end plug 17 and also act against the opposed shoulders 41 of the body portion 42 of the lead 15 to prevent axial movement of the lead 15 in the bore 16 of the end plug 17.

Figure 2:
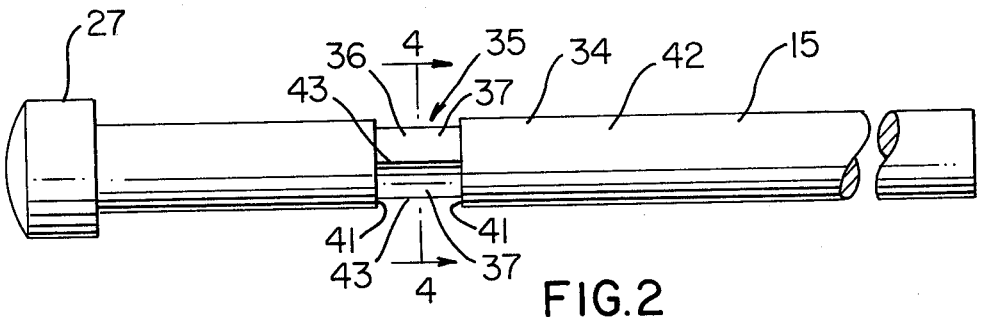
FIG. 2 is an enlarged side view of the improved conductive lead of this invention that is utilized in the thermally actuatable electrical switch construction of FIG. 1.

Of course, outward axial movement of the lead 15 relative to the end plug 17 is prevented by the enlarged head 27 abutting against the end 28 of the end plug 17. However, axially inward movement of that lead 15 relative to the end plug 17 is prevented by the right hand shoulder 41 of the lead 15 of FIGS. 1 and 2 bearing against the hardened block or blocks 39 of set epoxy resin material 23 so that the set block or blocks 39 must be either deformed or fractured or the lead 15 itself must be deformed to provide for such relative movement whether the same is axially inwardly or rotational relative to the end plug 17.

Figure 3:
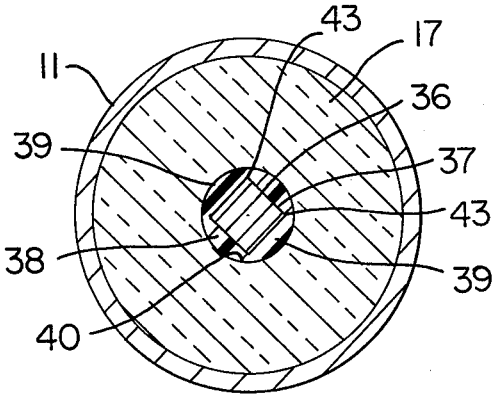
FIG. 3 is an enlarged cross-sectional view taken on line 3—3 of FIG. 1.
Figure 4:
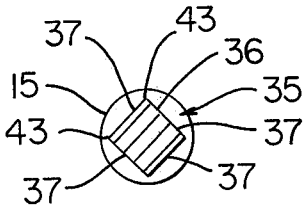
FIG. 4 is a cross-sectional view taken on line 4—4 of FIG. 2.

In the embodiment illustrated in the drawings, the annular reduced section 36 is formed with a substantially square cross section throughout the entire length thereof so that there are four equal flat sides 37 which cooperate with the opening means 16 to define four irregular pockets 38 for subsequently forming the irregularly shaped set blocks 39 of epoxy resin 23. The corners 43 of the square shape as illustrated in FIG. 3 are all disposed inboard of the exterior peripheral cylindrical surface 43 of the body 42 of the lead 15 so that the epoxy material 23 that seeps into the annular recess 35 of the lead 15 completely surrounds the same in a circumferential direction.

While the annular reduced section 36 of the lead 15 of this invention can be formed in any suitable manner, it is believed that same can be formed therein at the same time the enlarged head 27 is being formed on the lead 15 by a cold forming operation, the portion 34 of the lead normally being held in cooperating anvil-like jaws of the cold forming apparatus while the enlarged head 27 is being formed by a cold upsetting of the extending portion of the lead 15 beyond the holding jaws. Thus, the jaws could be provided with suitable structure which would deform and form the lead 15 to produce the annular recess 35 and, thus, the annular section 36 with a plurality of flat sides 37 thereon for the purpose previously described.

However, it is to be understood that this invention is not to be limited to any manner of forming the annular reduced section 36 and it may be found that only one annular reduced section 36 is required for the portion 34 of the lead 15 or that a plurality of such annular sections 36 should be provided in spaced apart relation.

Since the operation of the completed thermally actuatable electrical switch construction 10 of this invention has been previously described, it is deemed unnecessary to repeat such operation thereof.

Nevertheless, it can be seen that either after or before the temperature sensitive member 33 has melted, a person cannot readily push axially inwardly on the lead 15 nor tend to rotate the lead 15 relative to the end plug 17 because of the hardened block or blocks 39 of the set epoxy resin 23 that had previously seeped or otherwise entered into the opening means 16 during the disposing of the epoxy resin 23 on the outer end of the thermally actuatable electrical switch construction 10 to hermetically seal the lead 15 and open end 12 of the casing 11 in the manner previously described.

Therefore, it can be seen that this invention not only provides an improved thermally actuatable electrical switch construction and an improved conductive lead therefor, but also this invention provides improved methods for making such a thermally actuatable electrical switch construction and such a conductive lead therefor.

While the forms and methods of this invention have been illustrated and described as required by the Patent Statute, it is to be understood that other forms and method steps can be utilized and still fall within the scope of the appended claims.

What is claimed is:

1. In a thermally actuatable electrical switch construction having a housing means carrying an electrically insulating end plug provided with an opening means passing therethrough and in which a portion of a conductive lead is disposed so that opposed ends of said lead extend beyond opposed ends of said plug and respectively define a fixed contact means inside said housing means and a terminal outside said housing means, said portion of said lead being retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement wherein said portion of said lead has a substantially cylindrical peripheral surface throughout the entire length thereof with an annular recess therein that defines an annular reduced section in said portion that has an annular peripheral surface disposed inboard of said cylindrical peripheral surface throughout its entire length and has at least one flat surface part thereof that interlocks with said sealing means in said opening means of said end plug.

2. A thermally actuatable electrical switch construction as set forth in claim 1 wherein said flat surface part of said section of said portion of said lead extends throughout substantially the longitudinal length of said section.

3. A thermally actuatable electrical switch construction as set forth in claim 2 wherein said section of said portion of said lead has a substantially rectangular cross-sectional shape whereby said annular peripheral surface thereof has four flat surface parts.

4. A thermally actuatable electrical switch construction as set forth in claim 3 wherein said rectangular cross-sectional shape is substantially a square whereby said four flat surface parts are substantially identical.

5. A thermally actuatable electrical switch construction as set forth in claim 4 wherein said section is substantially coaxially aligned with said portion of said lead.

6. In a method of making a thermally actuatable electrical switch construction having a housing means carrying an electrically insulating end plug provided with an opening means passing therethrough and in which a portion of a conductive lead is disposed so that opposed ends of said lead extend beyond opposed ends of said plug and respectively define a fixed contact means inside said housing means and a terminal outside said housing means, said portion of said lead being retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement comprising the step of forming an annular recess in the substantially cylindrical peripheral surface of said portion of said lead that defines an annular reduced section in said portion that has an annular peripheral surface disposed inboard of said cylindrical peripheral surface throughout its entire length and has at least one flat surface part thereof that interlocks with said sealing means in said opening means of said end plug.

7. A method of making a thermally actuatable electrical switch construction as set forth in claim 6 and including the step of forming said flat surface part of said section of said portion of said lead to extend substantially throughout the longitudinal length of said section.

8. A method of making a thermally actuatable electrical switch construction as set forth in claim 7 and including the step of forming said section of said portion of said lead to have a substantially rectangular cross-sectional shape whereby said annular peripheral surface thereof has four flat surface parts.

9. A method of making a thermally actuatable electrical switch construction as set forth in claim 8 and including the step of forming said rectangular cross-sectional shape to be substantially a square whereby said four surface parts are substantially identical.

10. A method of making a thermally actuatable electrical switch construction as set forth in claim 9 wherein said step of forming said annular recess forms said section to be substantially coaxially aligned with said portion of said lead.

11. In a conductive lead for a thermally actuatable electrical switch construction having a housing means carrying an electrically insulating end plug provided with an opening means passing therethrough and in which a portion of said conductive lead is adapted to be disposed so that opposed ends of said lead are adapted to extend beyond opposed ends of said plug and respectively define a fixed contact means inside said housing means and a terminal outside said housing means, said portion of said lead being adapted to be retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement wherein said portion of said lead has a substantially cylindrical peripheral surface throughout the entire length thereof with an annular recess therein that defines an annular reduced section in said portion that has an annular peripheral surface disposed inboard of said cylindrical peripheral surface throughout its entire length and has at least one flat surface part thereof that is adapted to interlock with said sealing means in said opening means of said end plug.

12. A conductive lead for a thermally actuatable electrical switch construction as set forth in claim 11 wherein said flat surface part of said section of said portion of said lead extends throughout substantially the longitudinal length of said section.

13. A conductive lead for a thermally actuatable electrical switch construction as set forth in claim 12 wherein said section of said portion of said lead has a substantially rectangular cross-sectional shape whereby said annular peripheral surface thereof has four flat surface parts.

14. A conductive lead for a thermally actuatable electrical switch construction as set forth in claim 13 wherein said rectangular cross-sectional shape is substantially a square whereby said four flat surface parts are substantially identical.

15. A conductive lead for a thermally actuatable electrical switch construction as set forth in claim 14 wherein said section is substantially coaxially aligned with said portion of said lead.

16. In a method of making a conductive lead for a thermally actuatable electrical switch construction having a housing means carrying an electrically insulating end plug provided with an opening means passing therethrough and in which a portion of said conductive lead is adapted to be disposed so that opposed ends of said lead are adapted to extend beyond opposite ends of said plug and respectively define a fixed contact means inside said housing means and a terminal outside said housing means, said portion of said lead being adapted to be retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement comprising the step of forming an annular recess in the substantially cylindrical peripheral surface of said portion of said lead that defines an annular reduced section in said portion that has an annular peripheral surface disposed inboard of said cylindrical peripheral surface throughout its entire length and has at least one flat surface part thereof that is adapted to interlock with said sealing means in said opening means of said end plug.

17. A method of making a conductive lead for a thermally actuatable electrical switch construction as set forth in claim 16 and including the step of forming said flat surface part of said section of said portion of said lead to extend throughout substantially the longitudinal length of said section.

18. A method of making a conductive lead for a thermally actuatable electrical switch construction as set forth in claim 17 and including the step of forming said section of said portion of said lead to have a substantially rectangular cross-sectional shape whereby said annular peripheral surface thereof has four flat surface parts.

19. A method of making a conductive lead for a thermally actuatable electrical switch construction as set forth in claim 18 and including the step of forming said rectangular cross-sectional shape to be substantially a square whereby said four surface parts are substantially identical.

20. A method of making a conductive lead for a thermally actuatable electrical switch construction as set forth in claim 19 wherein said step of forming said annular recess forms said section to be substantially coaxially aligned with said portion of said lead.

* * * * *